US010016024B2

(12) United States Patent
Galu, Jr.

(10) Patent No.: US 10,016,024 B2
(45) Date of Patent: Jul. 10, 2018

(54) CURRENT, TEMPERATURE OR ELECTROMAGNETIC ACTUATED FASTENERS

(71) Applicant: Texas Instruments Incorporated, Dallas, TX (US)

(72) Inventor: James Joseph Galu, Jr., Richardson, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 15/063,265

(22) Filed: Mar. 7, 2016

(65) Prior Publication Data

US 2016/0183639 A1 Jun. 30, 2016

Related U.S. Application Data

(63) Continuation of application No. 14/022,996, filed on Sep. 10, 2013, now Pat. No. 9,277,789.

(51) Int. Cl.
*A44B 18/00* (2006.01)

(52) U.S. Cl.
CPC ..... *A44B 18/008* (2013.01); *A44B 18/0073* (2013.01); *A44B 18/0096* (2013.01); *Y10T 24/2767* (2015.01); *Y10T 29/49826* (2015.01)

(58) Field of Classification Search
CPC ..... A44B 18/008; A44B 18/0073; A44B 18/0096; Y10T 29/49826; Y10T 24/2767
See application file for complete search history.

(56) References Cited

U.S. PATENT DOCUMENTS

| | | | |
|---|---|---|---|
| 3,995,969 | A | 12/1976 | Fleming |
| 5,679,883 | A | 10/1997 | Wedeven |
| 6,000,084 | A | 12/1999 | Briscoe |
| 6,425,169 | B1 | 7/2002 | Briscoe |

(Continued)

FOREIGN PATENT DOCUMENTS

| | | |
|---|---|---|
| WO | 2008155107 | 12/2008 |

OTHER PUBLICATIONS

Patent Prosecution History for U.S. Appl. No. 14/022,996, from Sep. 10, 2013 to Feb. 18, 2016, 157 pages.

*Primary Examiner* — Richard Chang
(74) *Attorney, Agent, or Firm* — Michael A. Davis; Charles A. Brill; Frank D. Cimino

(57) ABSTRACT

A method of bonding or debonding objects includes providing a first object including a first substrate with moveable features thereon which provide an actuated and a non-actuated state having different protrusion from the first substrate or a different curvature. A second object has an array of loops thereon. The moveable features while in one of the actuated state and non-actuated state are positioned, sized and shaped to fit within the loops. The moveable features include or are mechanically coupled to a material which responds to application of an actuating condition including electrical current, temperature, or an electromagnetic field by changing between the actuated state and the non-actuated state. Electrical current, temperature, or an electromagnetic field is automatically applied or changed to trigger a state change between the actuated state and non-actuated state that results in a bonding event or a debonding event between the first object and the second object.

8 Claims, 5 Drawing Sheets

(56) References Cited

U.S. PATENT DOCUMENTS

| | | | | |
|---|---|---|---|---|
| 6,546,602 | B1 * | 4/2003 | Eipper | A44B 18/0003 24/304 |
| 6,598,274 | B1 | 7/2003 | Marmaropoulos | |
| 6,766,566 | B2 | 7/2004 | Cheng et al. | |
| 6,920,675 | B2 | 7/2005 | Browne et al. | |
| 6,944,920 | B2 | 9/2005 | Browne et al. | |
| 6,973,701 | B2 | 12/2005 | Momoda et al. | |
| 6,983,517 | B2 | 1/2006 | Golden et al. | |
| 7,013,538 | B2 | 3/2006 | Browne et al. | |
| 7,032,282 | B2 | 4/2006 | Powell et al. | |
| 7,140,081 | B2 | 11/2006 | Browne et al. | |
| 7,146,690 | B2 | 12/2006 | Stanford, Jr. et al. | |
| 7,188,398 | B2 | 3/2007 | Prevey | |
| 7,308,738 | B2 | 12/2007 | Barvosa-Carter et al. | |
| 7,430,788 | B2 * | 10/2008 | Ottaviani | A44B 18/0003 188/267 |
| 8,732,914 | B2 | 5/2014 | Browne et al. | |
| 2004/0074068 | A1 | 4/2004 | Browne et al. | |

* cited by examiner

CURRENT, TEMPERATURE OR ELECTROMAGNETIC ACTUATED FASTENERS

This application is a continuation of U.S. patent application Ser. No. 14/022,996 filed Sep. 10, 2013, the entirety of which is incorporated herein by reference.

FIELD

Disclosed embodiments relate to Velcro-like entangling configurations that provide bonding or debonding between a first member and a second member through application of an automatically applied stimulus.

BACKGROUND

The known "Velcro" fastener design is where one surface comprises an array flexible loops members with an opposing surface comprised of an array flexible members formed into hooks for entanglement with the loops. This design provides for entanglement upon physical contact between the hooks and the loops.

Velcro designs require manual application for hook and loop entanglement to occur and for hook and loop detanglement to occur. The strength of the Velcro bond is limited to facilitate its intended manual separation.

SUMMARY

Disclosed embodiments include Velcro-like fasteners. One disclosed embodiment comprises a method of bonding or debonding objects that includes providing a first object including a first substrate with a 2-dimensional (2D) array of moveable features thereon which provide an actuated state and a non-actuated state having a different protrusion from the first substrate or a different curvature, and a second object having a 2D array of loops on a second substrate. While in one of the actuated state and non-actuated state, the moveable features are positioned, sized and shaped to fit within the array of loops.

The array of moveable features include or are mechanically coupled to a material which responds to application of an actuating condition including electrical current, temperature, or an electromagnetic (EM) field by changing between the actuated state and non-actuated state. Electrical current, temperature, or an EM field is automatically applied or changed to trigger a state change between the actuated state and non-actuated state. The state change results in a bonding event or a debonding event between the first object and the second object.

BRIEF DESCRIPTION OF THE DRAWINGS

Reference will now be made to the accompanying drawings, which are not necessarily drawn to scale, wherein.

DETAILED DESCRIPTION

Figure 1:
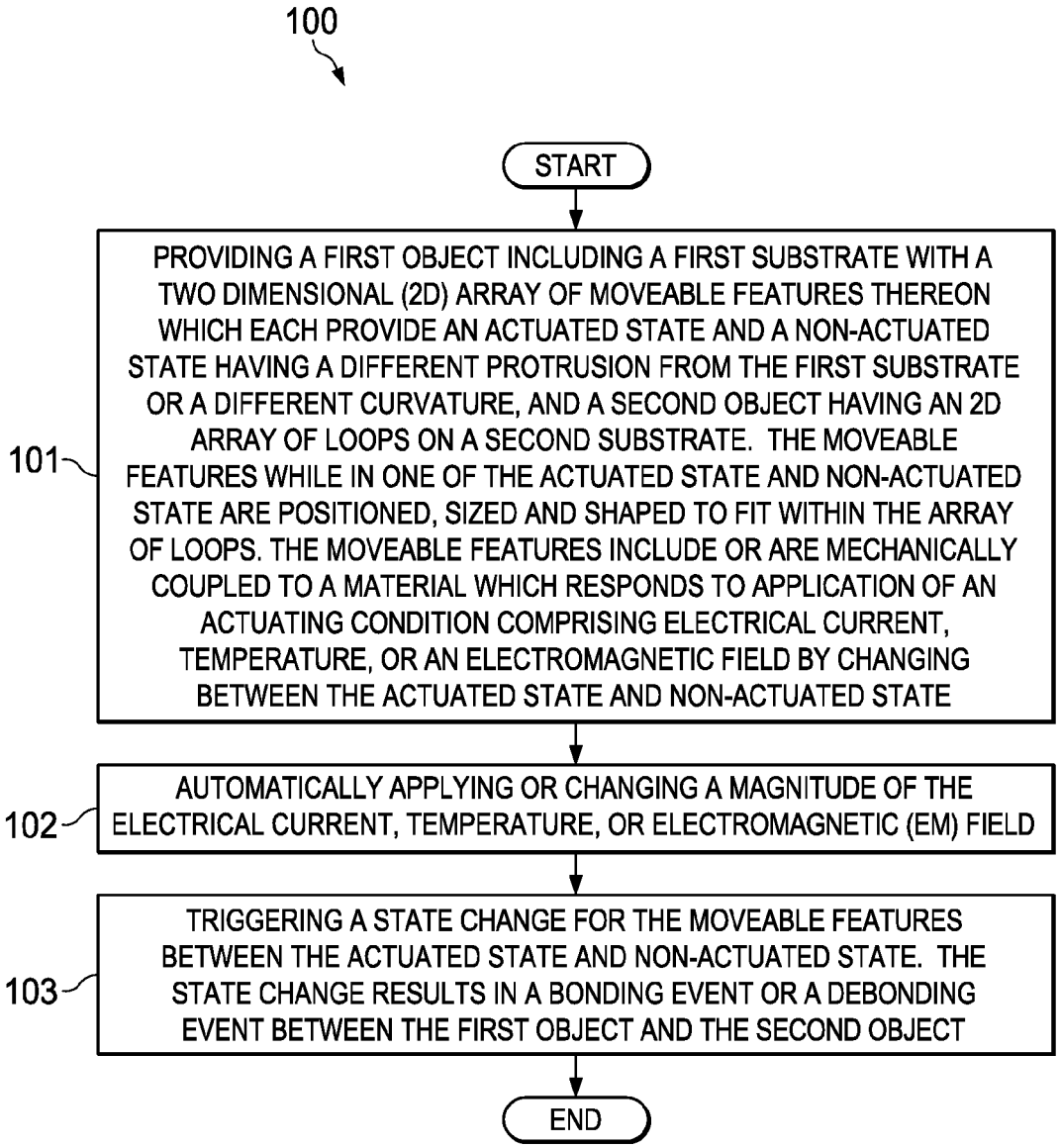
FIG. 1 is a flow chart that shows steps in an example method for bonding or debonding objects using current, temperature or EM field actuated fasteners, according to an example embodiment.

Example embodiments are described with reference to the drawings, wherein like reference numerals are used to designate similar or equivalent elements. Illustrated ordering of acts or events should not be considered as limiting, as some acts or events may occur in different order and/or concurrently with other acts or events. Furthermore, some illustrated acts or events may not be required to implement a methodology in accordance with this disclosure.

FIG. 1 is a flow chart that shows steps in an example method 100 method of bonding or debonding objects. Step 101 comprises providing a first object including a first substrate with a 2D array of moveable features thereon which provide an actuated state and a non-actuated state having a different protrusion from the first substrate or a different curvature, and a second object having a 2D array of loops on a second substrate. The moveable features while in one of the actuated state and non-actuated state are positioned, sized and shaped to fit within the array of loops. The array of moveable features include or are mechanically coupled to a material which responds to application of an actuating condition comprising electrical current, temperature, or an EM field by changing between the actuated state and non-actuated state.

The material for the moveable features and the material for the loops can be different. The loops in one embodiment can comprise conventional nylon being a polyamide (repeating units linked by amide bonds) which is a thermoplastic polymer, that as known in the art can be heat treated to form loops. The nylon material may also be impregnated with metal particles such as silver particles to provide electrical conductivity when desired, such as to enable an electrical current actuation embodiment where the electrical current applied passes in a path including both the moveable features and the loops (see FIG. 4 described below).

The material for the moveable features in one embodiment comprises a thermally responsive bimetallic plate (a "bimetallic"): In this embodiment a plate is formed of a first metal, which has a component (hereinafter referred to as a "cladding") of a second metal positioned against it to form the bimetallic plate. The first metal may be titanium, nickel or cobalt, a ferrous alloy or a titanium-, nickel- or cobalt-base alloy. The second metal different from the first metal for the cladding may be copper, nickel or cobalt, a ferrous alloy or a copper-, nickel- or cobalt-base alloy. While not necessarily the case, the first and second metals usually are typically compositionally different.

The respective metal materials in the bimetallic include a material of relatively low thermal expansion coefficient and a material of relatively high thermal expansion coefficient joined together along a common interface. The bimetallic actuator is in one of the two stable states depending on the temperature, with each state having a predetermined set-point temperature, with a first lower temperature state and a second higher temperature state. The difference between the two predetermined set-point temperatures corresponding to the respective first and second states of stability (stable states) is known as the "differential temperature" of the thermally responsive member. Generally, the bimetallic is intended to operate at a temperature above ambient temperature, and provide a snap-action arc when thermally actuated.

The material for the moveable features in another embodiment comprises a SMA material. A SMA material is an alloy that "remembers" its original, cold-forged shape, generally returning to its pre-deformed shape when heated. The SMA material is deformed while below a martensite finish temperature and then when heated to above an austenite temperature the alloy returns to its shape existing before the deformation. It is known the two main types of SMAs are copper-aluminium-nickel, and nickel-titanium (NiTi) alloys, but SMAs can also be created by alloying zinc, copper, gold and iron, or utilize other metal alloys.

Typical SMA actuators include a SMA member that is deformed in some manner and a return bias spring mechanically connected in some manner to the SMA member. When an SMA member is heated, thermally or by other means to above a critical temperature characteristic of the SMA material, the SMA actuator moves to perform some work function. The bias spring is treated (or trained) to be operable to return the actuator to its original position (e.g., a 1-way memory effect) or near the original position (e.g., a 2-way memory effect) after cooling below the critical temperature.

The material for the moveable features may also comprise carbon nanotubes that can be curled or straightened by the flow of electrical current. Other materials such as vinyl (a polymer having the functional group $—CH{=}CH_2$), paper, hair, rubber, and other natural or artificial materials for the moveable features can be used, provided they respond to electrical current, temperature, or EM fields including electrostatic or magnetic fields (with magnetic moveable features or materials) by changing states between an actuated state and a non-actuated state having a different protrusion from the first substrate or a different curvature.

Step 102 comprises automatically applying or changing (increasing or reducing) a magnitude of the electrical current, temperature, or EM field. In step 103 a state change is triggered for the moveable features between the actuated state and the non-actuated state, wherein the state change results in a bonding event or a debonding event between the first object and the second object. In one embodiment, at least the moveable features on the first object are electrically conductive and electrical current is used to allow for electronically controlled Velcro-like bonding and debonding to a second object having a 2D array of loops thereon.

To provide a state change, the moveable feature material can be rigid, but have flexibility upon the state change of curvature to move into the desired bonded (engaged) or debonded (released) position when activated or deactivated as needed by the configuration. Alternatively, the moveable feature material provided can be a rigid engager, which can move between positions based on the actuation state of an actuator that is mechanically coupled to the movable features. This can be embodied as a "cat claw"-like rigid engager that is pushed and pivoted from a recessed groove when activated by an actuator as depicted in FIGS. 2A-D described below.

Figure 2A:
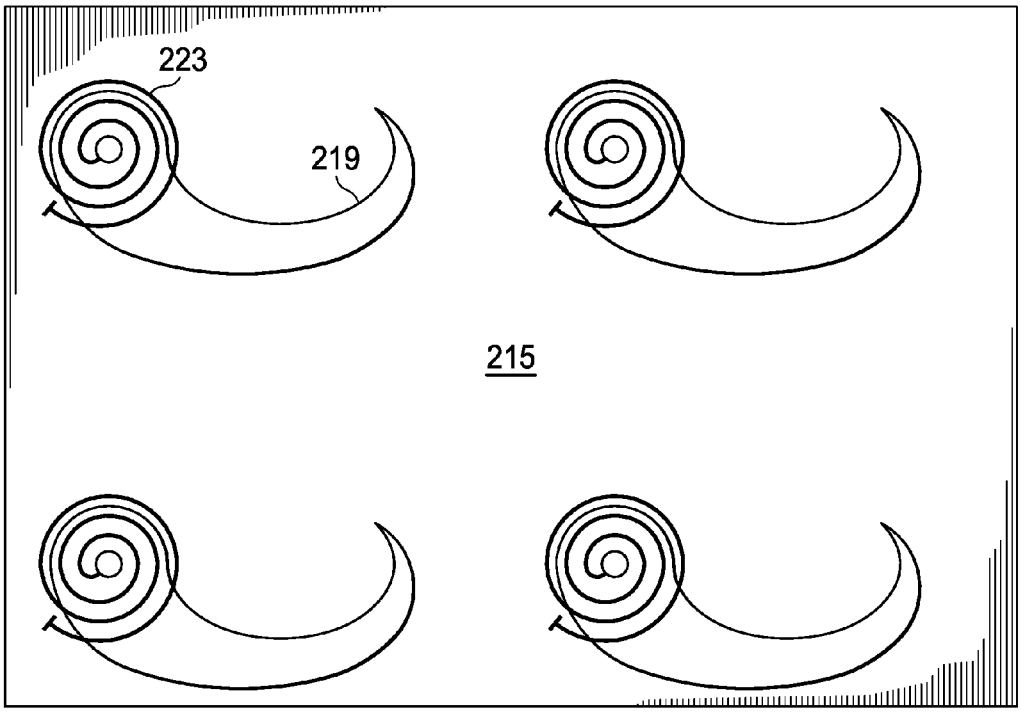
FIGS. 2A and 2B are depictions of an example array of moveable features comprising a "cat claw" shaped rigid engager on a substrate in an non-actuated and actuated state, respectively, for realizing an adhesive connection to loops for bonding or debonding objects upon exposure to an actuating condition, realized with a bimetallic spring coil actuator mechanically coupled to the cat claw engager.
Figure 2B:
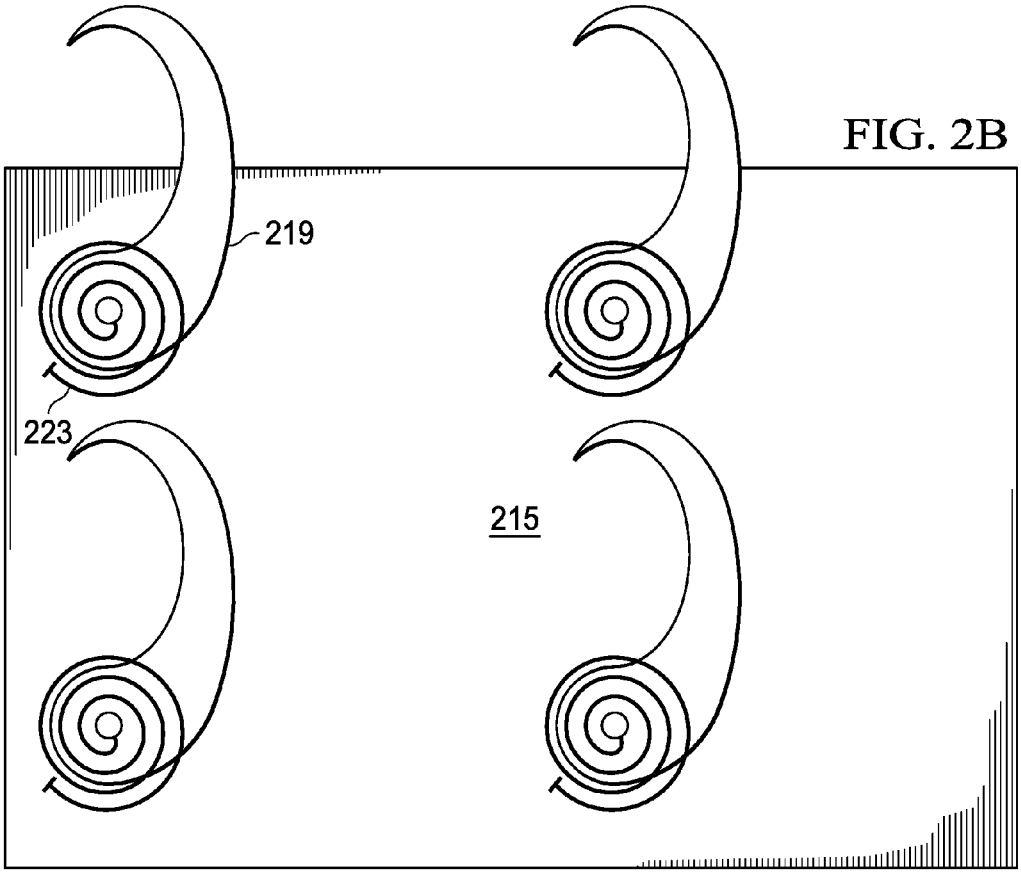

FIGS. 2A and 2B are depictions of an example array of moveable features comprising a "cat claw" shaped rigid engager 219 on a substrate 215 in a non-actuated and actuated state, respectively, for realizing an adhesive connection to a loop for bonding or debonding objects upon exposure to an actuating condition, comprising a bimetallic spring coil actuator 223 mechanically coupled to the cat claw engager 219. The "cat claw" shaped engager 219 can generally comprise any rigid material. In FIG. 2B, upon sufficient heating of the bimetallic spring coil actuator 223 the bimetallic spring coil actuator 223 provides a snap-action arc resulting in the cat claw engager 219 protruding out from the surface of the substrate 215. Although not shown in FIGS. 2A and 2B (see FIGS. 2C and 2D described below), a channel guide/groove is generally provided in the substrate 215 that confines the movement range of the cat claw engager 219.

Figure 2C:
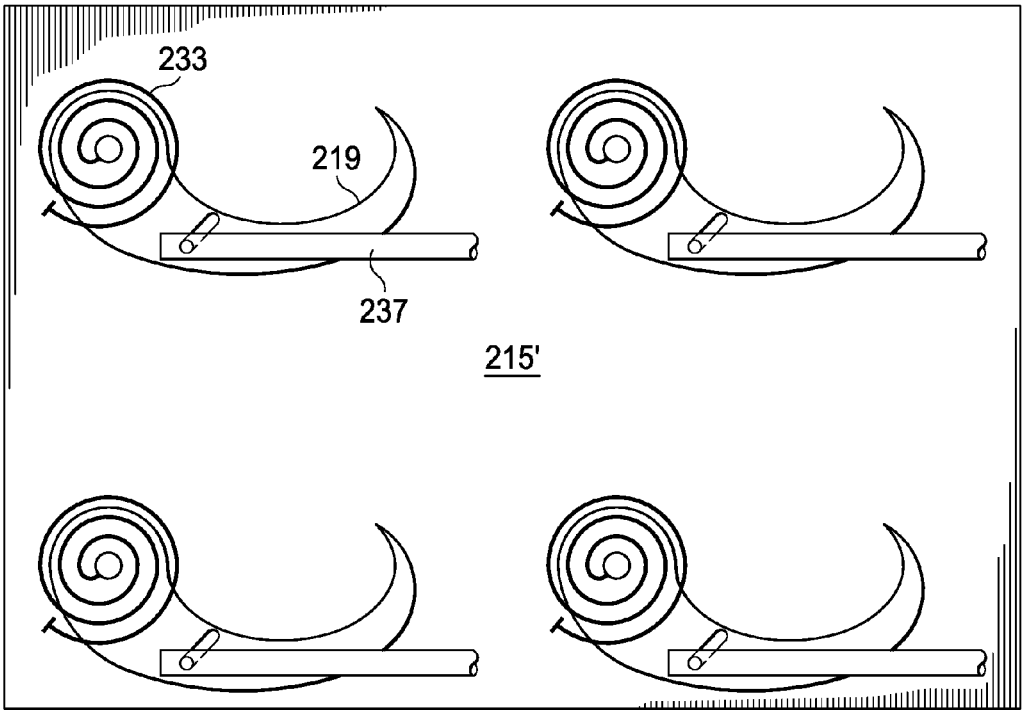
FIGS. 2C and 2D are depictions of an example array of moveable features comprising a "cat claw" shaped rigid engager on a substrate in an non-actuated and actuated state, respectively, for realizing an adhesive connection to loops for bonding or debonding objects upon exposure to an actuating condition, realized with a shape-memory alloy (SMA) actuator mechanically coupled to the cat claw engager.
Figure 2D:
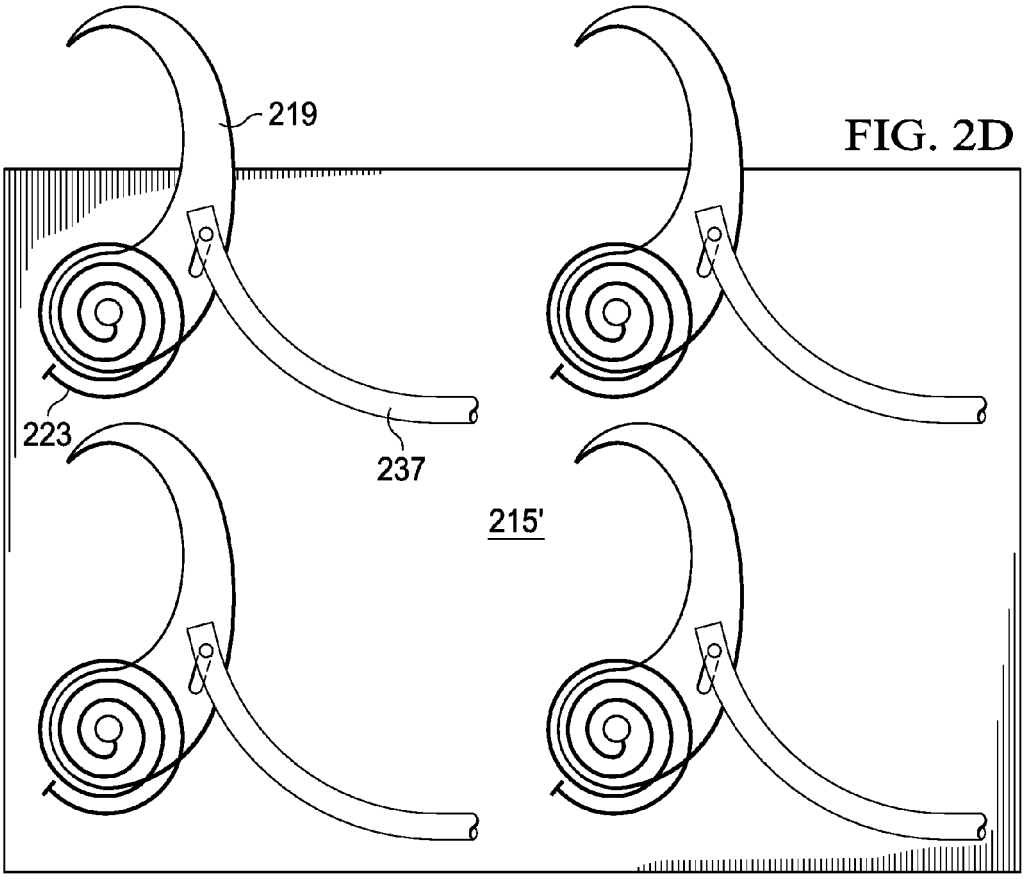

FIGS. 2C and 2D are depictions of an example array of moveable features comprising a cat claw shaped rigid engager 219 on a substrate 215' in a non-actuated and actuated state, respectively, for realizing an adhesive connection to a loop for bonding or debonding objects upon exposure to an actuating condition, comprising a SMA actuator 233 mechanically coupled to the cat claw engager 219. Straps 237 comprising a metal or polymer are shown which firmly bond one end of the SMA actuator 233 to the surface of the substrate 215'. The straps 237 can also serve as thermal or electrical channels for actuation of the SMA actuator 233. The straps 237 may have pilot holes on each side of the SMA material and may be held to the surface by solder joints, rivets, screws, or polymer bonding materials. Properly configured, the straps 237 allow for mechanical movement and actuation of the SMA actuator 233 while preventing the SMA material from becoming loose after numerous actuation cycles. A bias spring for returning the SMA actuator 233 to its original position after cooling below the critical temperature is not shown. The cat claw shaped rigid engager 219 can generally comprise any rigid material. In FIG. 2D, upon sufficient heating of the SMA actuator 233 the SMA actuator 233 moves resulting in the cat claw engager 219 protruding out from the surface of the substrate 215'.

Figure 3A:
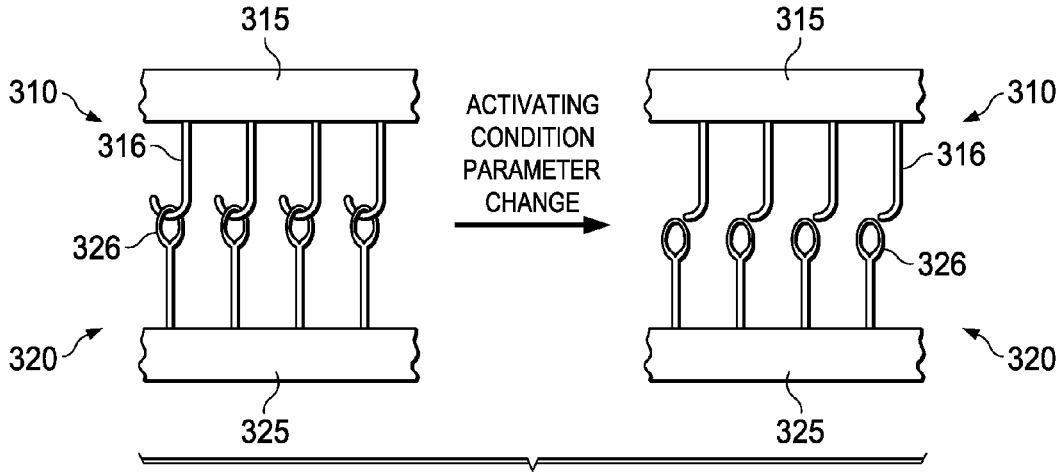
FIG. 3A depicts providing a first object having a 2D array of moveable features on a first substrate thereon bonded to a second object having a 2D array of loops on a second substrate, and after a actuating condition parameter change resulting in the debonding of the moveable features from the loops, according to an example embodiment.

FIG. 3A depicts providing a first object 310 having a 2D array of moveable features 316 on a first substrate 315 thereon bonded to a second object 320 having a 2D array of loops 326 on a second substrate 325. After an actuating condition parameter change as shown, debonding of the moveable features 316 from the loops 326 results.

Figure 3B:
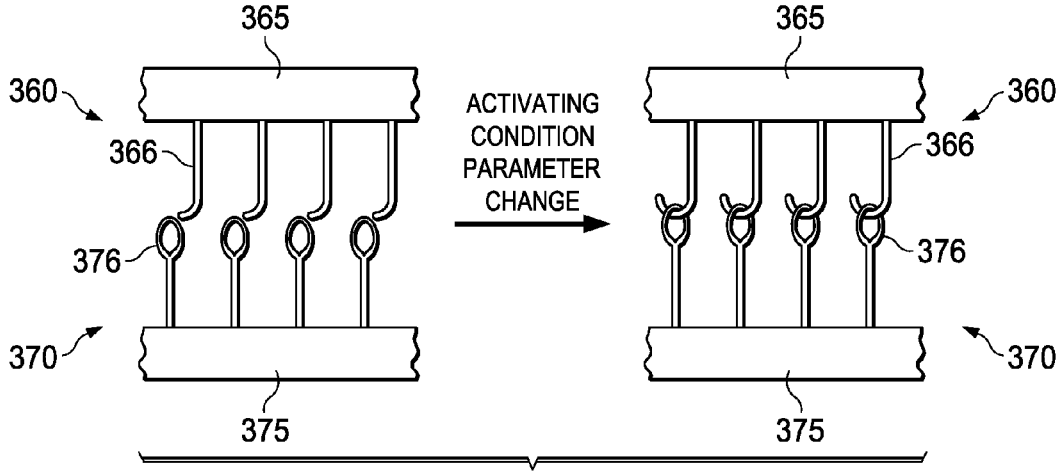
FIG. 3B depicts providing a first object having a 2D array of moveable features on a first substrate thereon proximate to but not bonded to a second object having a 2D array of loops on a second substrate, and after an actuating condition parameter change resulting in the bonding of the moveable features and the loops, according to an example embodiment.

FIG. 3B depicts providing a first object 360 having a 2D array of moveable features 366 on a first substrate 365 thereon proximate to but not bonded to a second object 370 having a 2D array of loops 376 on a second substrate 375.

After an actuating condition parameter change, as shown, bonding of the moveable features 366 and the loops 376 results.

Figure 4:
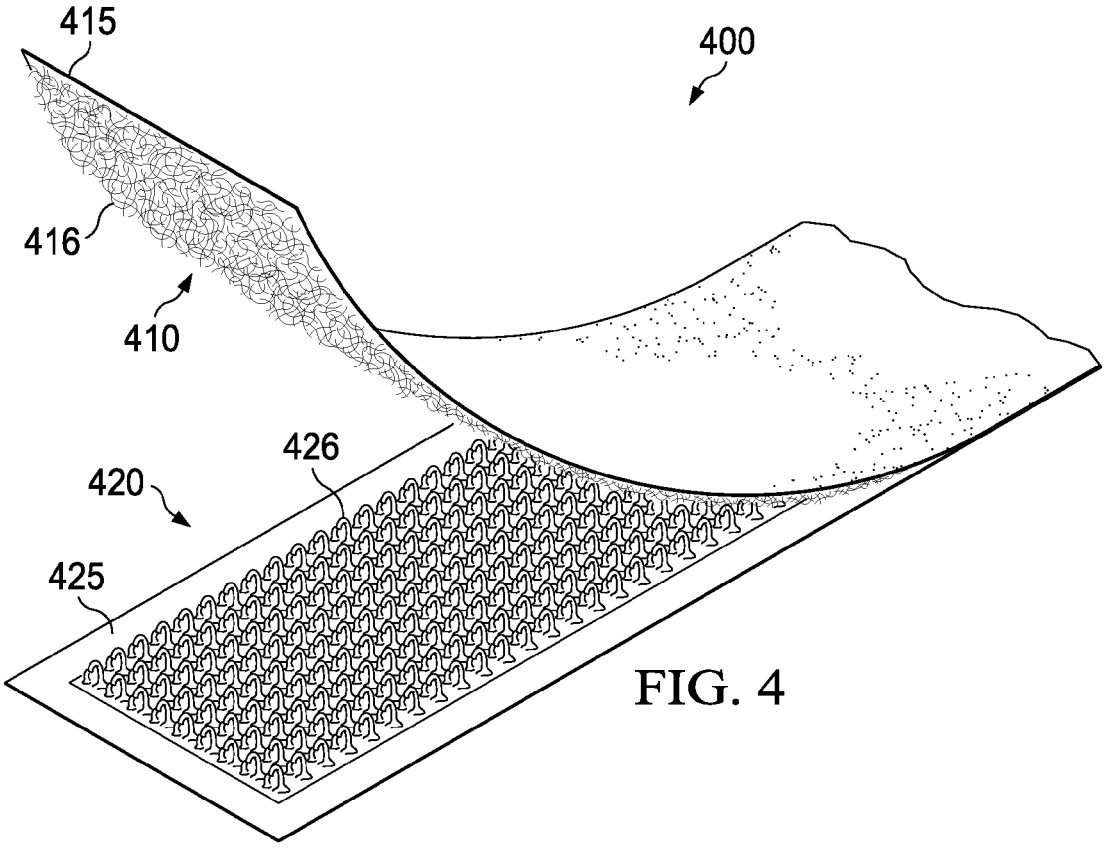
FIG. 4 is a depiction of a partially debonded example adhesive connection between a first object comprising a 2D array of moveable features on a first substrate which provide an actuated and a non-actuated state, and a second object comprising a 2D array of loops on a second substrate, according to an example embodiment.

FIG. 4 is a depiction of a partially debonded example strip adhesive connection 400 between a first object 410 comprising a 2D array of moveable features 416 on a first substrate 415 which provide an actuated state and a non-actuated state and a second object 420 comprising a 2D array of loops 426 on a second substrate 425, according to an example embodiment. In this embodiment the moveable features 416, the first substrate 415, the loops 426, and the second substrate 425 can all be electrically conductive, and electrical current run between the first object 410 and the second object 420 used to change the state of curvature of the moveable features 416 to provide the actuated state and non-actuated state for bonding and debonding.

Example mass production capable methods are provided for disclosed embodiments. In an example bimetallic spring coil actuator formation method, in a first step a mask is used to cut metal 1 tabs (e.g., rectangular shaped) pieces from a metal 1 layer or metal 1 sheet. In a second step, a mask is used to cut metal 2 tabs (e.g., rectangular shaped) pieces from a metal 2 layer or a metal 2 sheet. The metal 2 tabs are cut to preserve a connection, such as by cutting only 3 sides of a rectangular shape, so that the uncut side of the tab remains connected by the metal 2 material. Step 3 comprises bonding the metal 1 tabs to corresponding metal 2 tabs. The metal 1 tab bonded to metal 2 tab serve as the bimetallic actuators. The respective metal tabs may be bonded by metal or nylon rivets or screens or sleeves with a cap on the tab to prevent the sleeve from coming off. Holes on metal layer 2 cut in an oval shape allow mechanical slippage/movement when the actuator curls. Step 4 comprises bending the actuator tabs to about a 90° angle relative to the metal 2 sheet, which in operation curls when heat or current is applied. The metal 2 sheet can optionally be cut and bonded to a flexible layer (e.g. nylon) to allow added flexibility.

In an example SMA actuator bonding example, a first sewing machine-like method can be used to place SMA wires in a 2D array within apertures on a layer or a sheet (layer 1). The excess SMA wire can then be trimmed with the trimmed excess removed. Different trims will generally be used for active open (active release, e.g., trim to provide a 240° wire arc) and active closed (active grab e.g., trim to provide a 150° wire arc). Adhesive is then added to secure the SMA features. Additional layer(s), such as a layer 2, may be added with an adhesive on layer 1 opposite the SMA moveable features. Layer 2 can have heat conductive properties and can also have electrically conductive properties.

In an example cat claw design with SMA actuators example, in an initial step, step 1A, cat claw rigid engagers are created with a pivot hole in the axis of rotation and an off-center hole that receives the SMA wire for the purpose of causing the cat claw to rotate approximately 90 degrees from the rest state when actuated. In step 1B, layer 1 material is prepared for a cat claw array and includes groups of rows, such as three rows (Row 1, 2 and 3) that are equal width. Row 2 can have pilot holes equally spaced where rivets join and secure the cat claw pivot hole to the layer 1 material. Rows 1, 2 and 3 can be a repeated series in the material such that Row 1 of a new series starts after Row 3 of the previous series.

In step 1C, layer 1 will also have semicircular holes predrilled or otherwise formed in Row 2 around each pivot hole. The semicircular holes can be displaced from the pivot hole to accommodate the off-center hole described above and drilled such that the cat claw can pivot the full 90 degrees in the desired direction of pivot.

In step 2, rivets can be used o bind the cat claw engager to Layer 1 Row2 on the predrilled pilot holes with the point of each cat claw on the left side and pointing to Row3 on Layer 1. The semicircular holes should also be on the same side as the point of each cat claw engager and aligned with the off center hole on the engager.

In step 3, layer 1 is flipped so that Rows 1, 2 and 3 remain in the same position from left to right, but the mounted cat claws now have points on the right side. The SMA actuators are mounted to Row3 with bonding material securely fastening the SMA wire at the side of Row 3 that is farthest from Row 2. The free end of the SMA wires should point to and slightly overlap Row 2.

In step 4A, Layer 1 is folded between rows 1 and 2 such that Rows 1 and 2 form a tight "V" shape and create a recessed groove for the cat claw. Row 3 can be about 90 degrees from the Row 1 and 2 grooves. When the entire array of folds are complete, the groups of Row 3 material can comprise most of the flat surface of the array and Rows 1 and 2 (folded together perpendicular from Row 3) are now parallel fins that hold the cat claw engagers with the claw points towards the surface created by Row 3.

In step 4B, the unbonded end of the SMA wire in Row 3 are moved through the semicircular hole described above in Step 1C and popped into the off-center hole in the cat claw engager such that actuation will cause the cat claw to pop up or down (90 degrees) as needed for the configuration.

In step 5, a layer 2 material is adhered to layer 1 with oval holes predrilled to allow the cat claw engager array to rise and fall from the grooves created by the fold between layer 1 rows 1 and 2. Layer 2 will serve to keep the folded Layer 1 together and it can also serve as a heat or electrical channel for SMA actuation.

In step 6, the SMA used can be treated for two-way memory or the cat claw engager array can be equipped with bias springs to return the engagers to the rest position when cooled. This method or the first sewing machine-like method described above which each provide a 2D array of mechanically flexible features are both well adapted for ball grid array-like bonding described below to make a packaged semiconductor with an array of loops or bars (instead of solder balls) from a circuit component to a PCB board.

In an example SMA actuator bonding example metal or polymer straps (see straps 237 in FIGS. 2C and 2D) can be created to firmly bond one end of the SMA or other actuator material to a surface of a substrate. The straps can be configured in rows and arrays to allow for simultaneous activation of numerous SMA actuators. The straps can also be configured to bond single actuators to a surface where thermal or electrical isolation is desired and can also serve to tie an actuator to a specific signal trace on a PCB board. Additionally, the straps can comprise a thermally conductive and electrically insulating material when activation is desired while allowing the actuators to carry electrical signals that should be isolated from nearby actuators.

Disclosed loops may also be formed using known thermal techniques. For example, thermal techniques known for formation of nylon loops may be used for certain polymer materials.

Advantages of disclosed embodiments include stronger bonds than known Velcro, due to the ability to automatically control the debonding (release) as opposed to manual debonding. Disclosed bonds can be made stronger than that for conventional Velcro, so that it may be made difficult or not possible for a manual user to separate a disclosed bond by hand. Disclosed debonding (separation) may only be possible when a magnitude of the electrical current, temperature, or EM field is changed (increased or decreased).

There are a variety of applications for disclosed current, temperature or EM field actuated fasteners. Disclosed embodiments can be used to bond electrical components, such as integrated circuitry (IC) die or die stacks, and packaged semiconductors, to PCB boards. The actuator can be on either the component or the board. For example, a BGA semiconductor package can have disclosed current actuated moveable features into its PCB pin array on a base metal layer as opposed to conventional solder bumps with counterpart loops on the PCB or socket package. In this embodiment there is an electrical connection across the hook (moveable features) and loop pairs between the component and the PCB. Hook to loop pairing success should generally be essentially 100% in this embodiment. Signal isolation of each hook and loop pair from other hook and loop pairs in the array is provided to prevent shorting and component damage. Heat may be applied externally (through pins) as the current needed to generate this amount of thermal energy can damage the die. A thermally conductive but electrical insulating layer may be added to the BGA's PCB to provide a heat channel.

Disclosed embodiments can be used to "climb" walls or move on surfaces with loop material if the bind and release cycles are controlled. By alternating the grab and release on different parts of a disclosed array on a wheel covered by disclosed material, mobility can be achieved.

Disclosed embodiments with millimeter scale implementation (e.g., a 1 mm to 5 mm pitch) of moveable features can be used to cling to a woven cloth-like material (essentially loops) in the same way that Velcro hooks can cling to certain fabrics. If the array of engagers on the material are activated and deactivated in rows, columns or individually, then movement is possible if the activations and deactivations are appropriately sequenced.

Those skilled in the art to which this disclosure relates will appreciate that many other embodiments and variations of embodiments are possible within the scope of the claimed invention, and further additions, deletions, substitutions and modifications may be made to the described embodiments without departing from the scope of this disclosure.

The invention claimed is:

1. A method of bonding or debonding objects, the method comprising:

triggering a state change between an actuated state and a non-actuated state in a first object, said first object including a first substrate with a 2-dimensional (2D) array of rigid moveable engagers thereon that each provide said actuated state and said non-actuated state, said rigid moveable engagers including cat-claw shaped engagers, and said cat-claw shaped engagers being coupled to respective actuators, wherein: said rigid moveable engagers while in one of said actuated state and said non-actuated state are positioned, sized and shaped to fit within a 2D array of loops; said rigid moveable engagers respond to an actuating condition by changing between said actuated state and said non-actuated state; said cat-claw shaped engagers are rigid in both said actuated state and said non-actuated state; and said cat-claw shaped engagers have a same shape in both said actuated state and said non-actuated state; and said state change results in a bonding event or a debonding event between: said first object; and a second object having said 2D array of loops on a second substrate.

2. The method of claim 1, wherein said actuating condition comprises an electromagnetic field.

3. The method of claim 1, wherein said actuating condition comprises an electrical current.

4. The method of claim 1, wherein said actuators include a bimetal actuator or a shape memory alloy (SMA) actuator.

5. A fastener, comprising:

a first object including a first substrate with a 2-dimensional (2D) array of rigid moveable engagers thereon that each provide an actuated state and a non-actuated state, said rigid moveable engagers including cat-claw shaped engagers, and said cat-claw shaped engagers being coupled to respective actuators; and a second object having a 2D array of loops on a second substrate, wherein said rigid moveable engagers while in one of said actuated state and said non-actuated state are positioned, sized and shaped to fit within said array of loops;

wherein: said rigid moveable engagers are responsive to an actuating condition by changing between said actuated state and said non-actuated state; said cat-claw shaped engagers are rigid in both said actuated state and said non-actuated state; said cat-claw shaped engagers have a same shape in both said actuated state and said non-actuated state; and triggering a state change between said actuated state and said non-actuated state results in a bonding event or a debonding event between said first object and said second object.

6. The fastener of claim 5, wherein said actuators include a bimetal actuator or a shape memory alloy (SMA) actuator.

7. The fastener of claim 5, wherein said actuating condition comprises an electromagnetic field.

8. The fastener of claim 5, wherein said actuating condition comprises an electrical current.

* * * * *